US010544690B2

(12) United States Patent
Kirkendall et al.

(10) Patent No.: US 10,544,690 B2
(45) Date of Patent: Jan. 28, 2020

(54) INTERNAL AIRFOIL COMPONENT ELECTROPLATING

(71) Applicant: Howmet Corporation, Whitehall, MI (US)

(72) Inventors: Willard N. Kirkendall, Muskegon, MI (US); Scott A. Meade, Muskegon, MI (US); Donald R. Clemens, North Muskegon, MI (US)

(73) Assignee: HOWMET CORPORATION, Whitehall, MI (US)

( * ) Notice: Subject to any disclaimer, the term of this patent is extended or adjusted under 35 U.S.C. 154(b) by 0 days.

(21) Appl. No.: 15/732,490

(22) Filed: Nov. 20, 2017

(65) Prior Publication Data

US 2018/0080330 A1 Mar. 22, 2018

Related U.S. Application Data

(62) Division of application No. 14/120,004, filed on Apr. 14, 2014, now Pat. No. 9,840,918.

(60) Provisional application No. 61/854,561, filed on Apr. 26, 2013.

(51) Int. Cl.

| | |
|---|---|
| ***C25D 17/12*** | (2006.01) |
| ***F01D 5/28*** | (2006.01) |
| ***C25D 17/00*** | (2006.01) |
| ***C25D 7/04*** | (2006.01) |
| ***C25D 5/48*** | (2006.01) |
| ***C25D 5/02*** | (2006.01) |
| ***C25D 17/02*** | (2006.01) |
| ***F01D 5/12*** | (2006.01) |
| ***F01D 5/18*** | (2006.01) |
| *C25D 3/50* | (2006.01) |

(52) U.S. Cl.

CPC ..... *F01D 5/286* (2013.01); *C25D 5/022* (2013.01); *C25D 5/028* (2013.01); *C25D 5/48* (2013.01); *C25D 7/04* (2013.01); *C25D 17/008* (2013.01); *C25D 17/02* (2013.01); *C25D 17/12* (2013.01); *F01D 5/12* (2013.01); *F01D 5/18* (2013.01); *C25D 3/50* (2013.01)

(58) Field of Classification Search

None

See application file for complete search history.

(56) References Cited

U.S. PATENT DOCUMENTS

| | | | | |
|---|---|---|---|---|
| 2,641,439 A | | 6/1953 | Williams | 253/39.15 |
| 3,677,789 A | | 7/1972 | Bungardt et al. | 117/22 |
| 3,804,725 A | * | 4/1974 | Haynes | C25D 7/04 204/229.5 |
| 4,031,274 A | | 6/1977 | Bessen | |
| 4,323,433 A | | 4/1982 | Loch | 204/279 |

(Continued)

FOREIGN PATENT DOCUMENTS

| | | |
|---|---|---|
| AT | 303503 | 9/2005 |
| DE | 60022300 | 6/2006 |

(Continued)

OTHER PUBLICATIONS

English translation of JP 63243297 (Year: 1988).*

*Primary Examiner* — Stefanie S Wittenberg
(74) *Attorney, Agent, or Firm* — Greenberg Traurig, LLP

(57) ABSTRACT

Method and apparatus are provided for electroplating a surface area of an internal wall defining a cooling cavity present in a gas turbine engine airfoil component.

9 Claims, 5 Drawing Sheets

(56) References Cited

U.S. PATENT DOCUMENTS

| | | | | |
|---|---|---|---|---|
| 4,526,814 | A | 7/1985 | Shankar | 427/253 |
| 5,098,542 | A | 3/1992 | Reinhardt | 204/297.5 |
| 5,102,509 | A | 4/1992 | Albon et al. | 205/257 |
| 5,139,824 | A | 8/1992 | Liburdi | 427/252 |
| 5,261,963 | A | 11/1993 | Basta | 118/724 |
| 5,264,245 | A | 11/1993 | Punola | 427/237 |
| 5,788,823 | A | 8/1998 | Warnes | 205/192 |
| 5,902,471 | A | 5/1999 | Jordan | 205/122 |
| 5,985,122 | A | 11/1999 | Conner | |
| 6,234,752 | B1 | 5/2001 | Wei | 416/96 |
| 6,265,022 | B1 | 7/2001 | Fernihough et al. | |
| 6,290,461 | B1 | 9/2001 | Wei | 204/224 M |
| 6,413,584 | B1 | 7/2002 | Wustman | 427/250 |
| 6,435,835 | B1 | 8/2002 | Allen et al. | |
| 6,502,304 | B2 | 1/2003 | Rigney | 29/889.2 |
| 6,589,668 | B1 | 7/2003 | Braithwaite | 428/610 |
| 6,743,350 | B2 | 6/2004 | Lee et al. | |
| 6,793,966 | B2 | 9/2004 | Warnes | 427/248.1 |
| 6,929,825 | B2 | 8/2005 | Wustman | 427/250 |
| 7,056,555 | B2 | 6/2006 | Bauer et al. | |
| 7,087,143 | B1 * | 8/2006 | Schmidt | C25D 7/12 118/416 |
| 7,192,622 | B2 | 3/2007 | Fernihough et al. | |
| 7,494,576 | B2 | 2/2009 | Rosenweig | 204/288 |
| 7,501,328 | B2 | 3/2009 | Lockhard | 438/466 |
| 7,560,014 | B2 | 7/2009 | Rucker | 205/96 |
| 7,645,485 | B2 | 1/2010 | Madhava | 427/252 |
| 7,838,070 | B2 | 11/2010 | Gupta | 427/237 |
| 9,828,863 | B2 | 11/2017 | Kirkendall | 427/252 |
| 2002/0119043 | A1 | 8/2002 | Allen et al. | |
| 2004/0018299 | A1 | 1/2004 | Arnold | 427/140 |
| 2006/0042932 | A1 | 3/2006 | Rosenweig | 204/230.2 |
| 2006/0275624 | A1 | 12/2006 | Rucker | 428/689 |
| 2007/0289868 | A1 | 12/2007 | Ellis | 204/280 |
| 2008/0075604 | A1 | 3/2008 | Jabado | 416/241 |
| 2010/0175780 | A1 | 7/2010 | Liu | 141/65 |
| 2012/0222306 | A1 | 9/2012 | Mittendorf | 29/889.1 |
| 2012/0247967 | A1 * | 10/2012 | James | C25D 5/026 205/136 |
| 2013/0075263 | A1 | 3/2013 | Shawn | 205/81 |

FOREIGN PATENT DOCUMENTS

| | | | | |
|---|---|---|---|---|
| EP | 1 652 965 | | 5/2006 | |
| EP | 1111192 | A1 | 6/2007 | |
| EP | 2505692 | | 10/2012 | |
| ES | 2248021 | | 3/2006 | |
| GB | 1 213 821 | | 4/1968 | |
| GB | 2181744 | | 4/1987 | |
| JP | 58-217693 | | 12/1983 | |
| JP | 63243297 | * | 10/1988 | C25D 7/00 |
| JP | 11-229181 | | 8/1999 | |
| JP | 2001-214704 | | 8/2001 | |
| JP | 2004-035902 | | 2/2004 | |
| JP | 2007-039779 | | 2/2007 | |

* cited by examiner

INTERNAL AIRFOIL COMPONENT ELECTROPLATING

RELATED APPLICATION

This application is a division of copending Ser. No. 14/120,004 filed Apr. 14, 2014, which claims benefit and priority of U.S. provisional application Ser. No. 61/854,561 filed Apr. 26, 2013, the entire disclosures of which are incorporated herein by reference.

FIELD OF THE INVENTION

The present invention relates to the electroplating of a surface area of an internal wall defining a cooling cavity present in a gas turbine engine airfoil component in preparation for aluminizing to form a modified diffusion aluminide coating on the plated area.

BACKGROUND OF THE INVENTION

Increased gas turbine engine performance has been achieved through the improvements to the high temperature performance of turbine engine superalloy blades and vanes using cooling schemes and/or protective oxidation/corrosion resistant coatings so as to increase engine operating temperature. The most improvement from external coatings has been through the addition of thermal barrier coatings (TBC) applied to internally cooled turbine components, which typically include a diffusion aluminide coating and/or MCrAlY coating between the TBC and the substrate superalloy.

However, there is a need to improve the oxidation/corrosion resistance of internal surfaces forming cooling passages or cavities in the turbine engine blade and vane for use in high performance gas turbine engines.

SUMMARY OF THE INVENTION

The present invention provides a method and apparatus for electroplating of a surface area of an internal wall defining a cooling passage or cavity present in a gas turbine engine airfoil component to deposit a noble metal, such as Pt, Pd, etc. that will become incorporated in a subsequently formed diffusion aluminide coating formed on the surface area in an amount of enrichment to improve the protective properties thereof.

In an illustrative embodiment of the invention, an elongated anode is positioned inside the cooling cavity of the airfoil component, which is made the cathode of an electrolytic cell, and an electroplating solution containing the noble metal is flowed into the cooling cavity during at least part of the electroplating time. The anode has opposite end regions supported on an electrical insulating anode support. The anode and the anode support are adapted to be positioned in the cooling cavity. The anode support can be configured to function as a mask so that only certain surface area(s) is/are electroplated, while other areas are left unplated as a result of masking effect of the anode support. The electroplating solution can contain a noble metal including Pt, Pd, Au, Ag, Rh, Ru, Os, Ir and/or alloys thereof in order to deposit a noble metal layer on the selected surface area.

Following electroplating, a diffusion aluminide coating is formed on the plated internal surface area by gas phase aluminizing (e.g. CVD, above-the-pack, etc.), pack aluminizing, or any suitable aluminizing method so that the diffusion aluminide coating is modified to include an amount of noble metal enrichment to improve its high temperature performance.

The airfoil component can have one or multiple cooling cavities that are concurrently electroplated and then aluminized.

These and other advantages of the invention will become more apparent from the following drawings taken with the detailed description.

DETAILED DESCRIPTION OF THE INVENTION

The invention provides a method and apparatus for electroplating a surface area of an internal wall defining a cooling cavity present in a gas turbine engine airfoil component, such as a turbine blade or vane, or segments thereof. A noble metal including Pt, Pd, Au, Ag, Rh, Ru, Os, Ir, and/or alloys thereof is deposited on the surface area and will become incorporated in a subsequently formed diffusion aluminide coating formed on the surface area in an amount of noble metal enrichment to improve the protective properties of the noble metal-modified diffusion aluminide coating.

Figure 1:
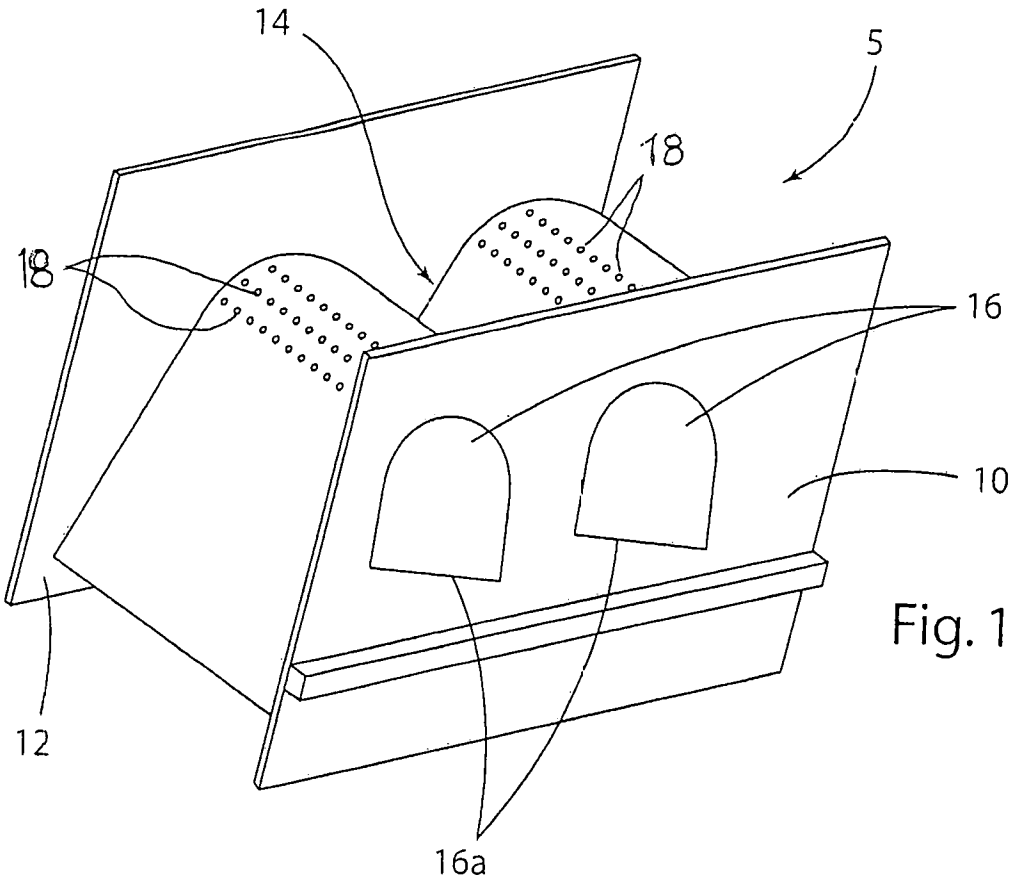
FIG. 1 is a schematic perspective view of a gas turbine engine vane segment having multiple (two) internal cooling cavities to be protectively coated at certain surface areas.
Figures 2, 3:
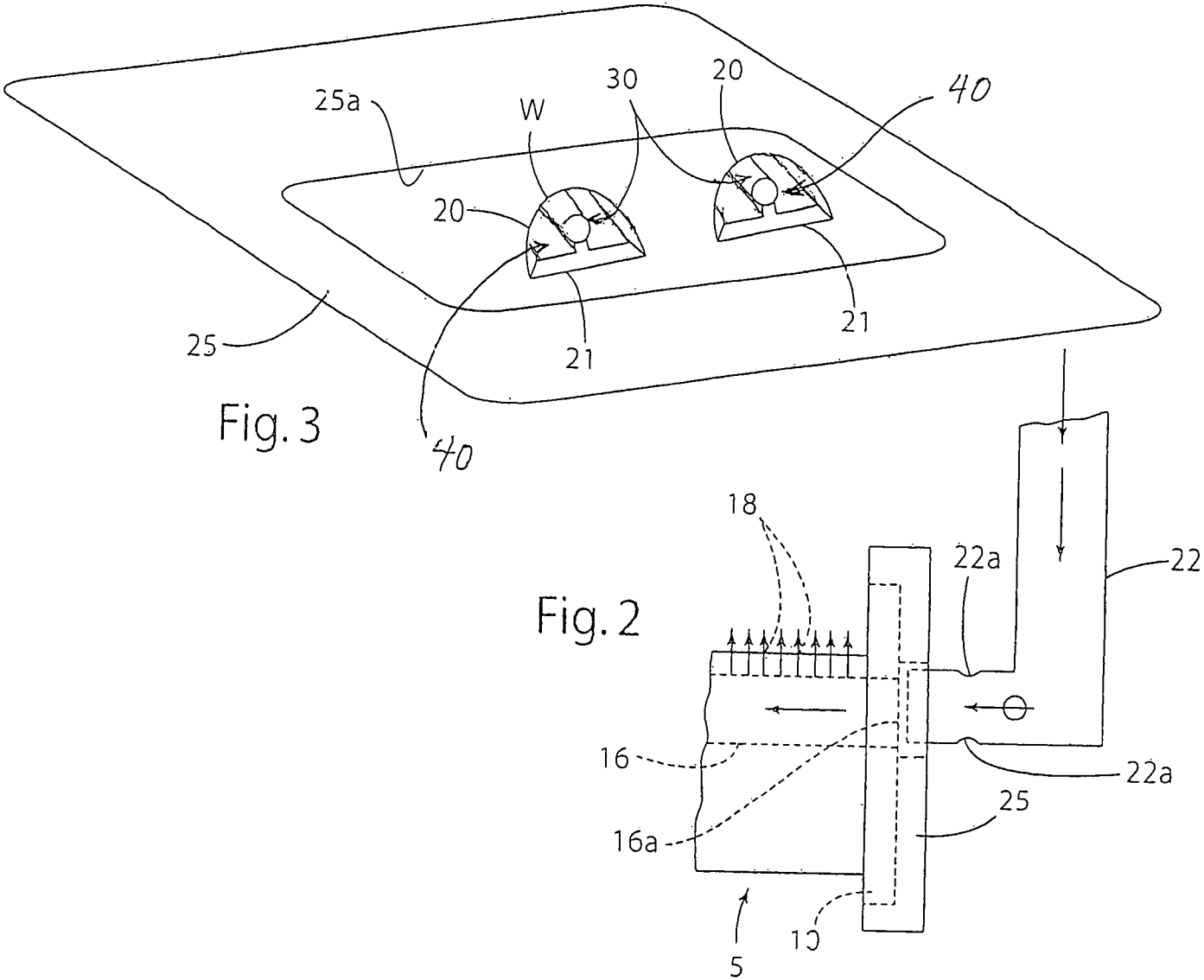
FIG. 2 is a partial side elevation of the vane segment showing a single cooling cavity with laterally extending cooling air exit passages or holes terminating at the trailing edge of the vane segment.
FIG. 3 is a perspective view of the mask showing the two cooling cavities and an anode on an anode support in each cooling cavity.

For purposes of illustration and not limitation, the invention will be described in detail below with respect to electroplating a selected surface area of an internal wall defining a cooling cavity present in a gas turbine engine vane segment 5 of the general type shown in FIG. 1 wherein the vane segment 5 includes first and second enlarged shroud regions 10, 12 and an airfoil-shaped region 14 between the shroud regions 10, 12. The airfoil-shaped region 14 includes multiple (two shown) internal cooling passages or cavities 16 that each have an open end **16*a* to receive cooling air and that extends longitudinally from shroud region 10 toward shroud region 12 inside the airfoil-shaped region. The cooling air cavities 16 each have a closed internal end remote from open ends 16*a* and are communicated to cooling air exit passages 18 extending laterally from the cooling cavity 16 as shown in FIG. 2 to an external surface of the airfoil where cooling air exits. The vane segment 5** can be made of a conventional nickel base superalloy, cobalt base superalloy, or other suitable metal or alloy for a particular gas turbine engine application.

Figure 4:
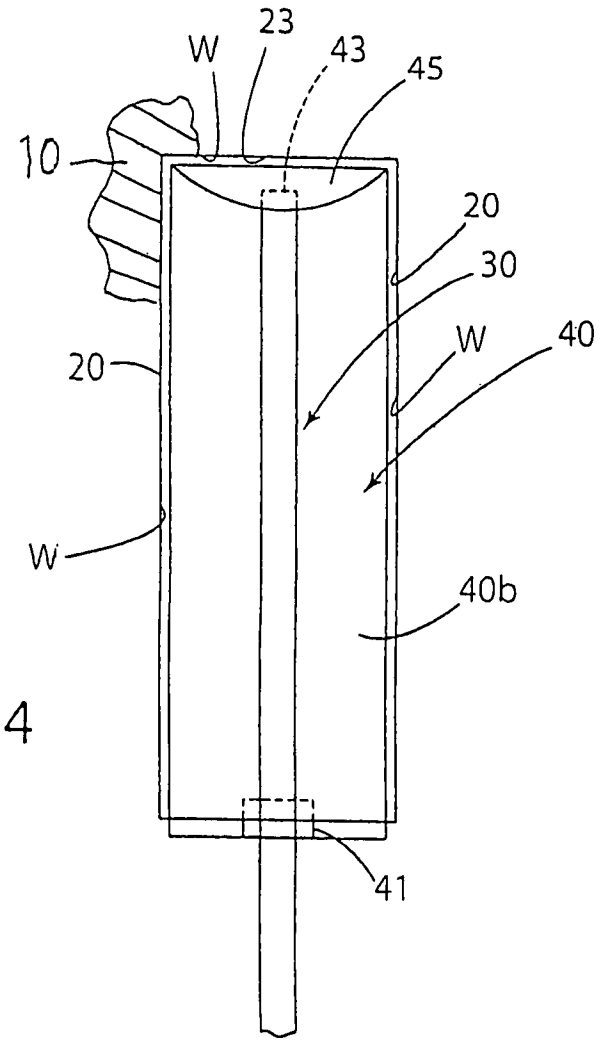
FIG. 4 is a top view of one anode on an anode support in one of the cooling cavities.
Figure 5:
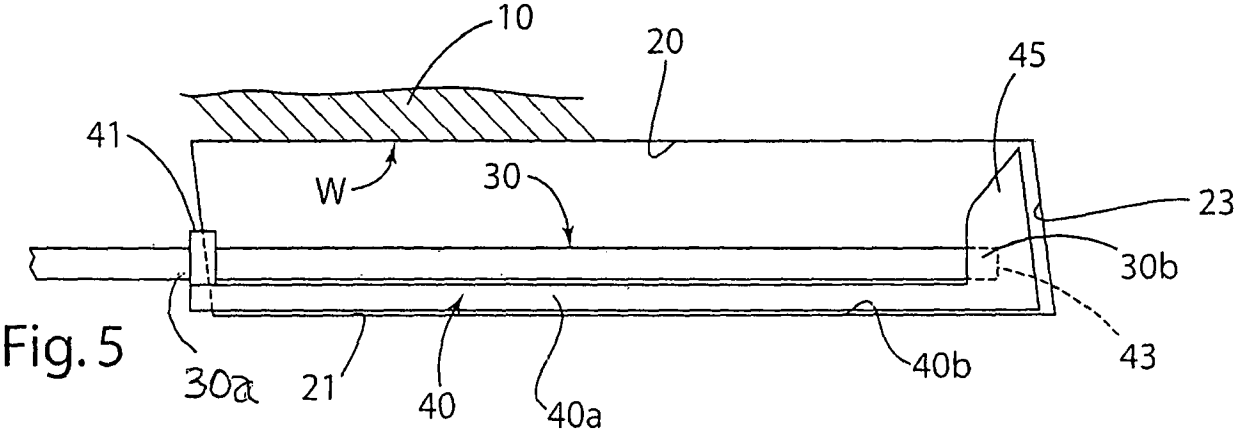
FIG. 5 is a side elevation of an anode on an anode support in one of the cooling cavities.
Figure 6:
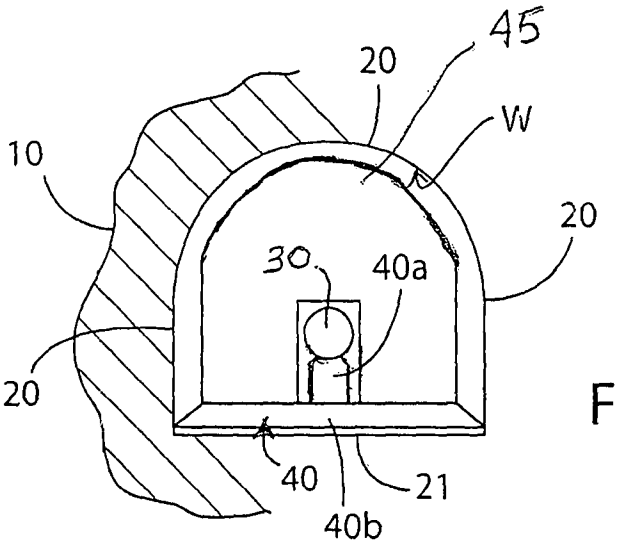
FIG. 6 is an end view of the anode-on-support of FIG. 5.

In one application, a selected surface area 20 of the internal wall W defining each cooling cavity 16 is to be coated with a protective noble metal-modified diffusion aluminide coating, FIGS. 4-6. Another generally flat surface area 21 and closed-end area 23 of the internal wall W are left uncoated when coating is not required there and to save on noble metal costs. For purposes of illustration and not limitation, the invention will be described below in connection with a Pt-enriched diffusion aluminide, although other noble metals can be used to enrich the diffusion aluminide coating, such other noble metals including Pt, Pd, Au, Ag, Rh, Ru, Os, Ir, and/or alloys thereof.

Figures 7, 8:
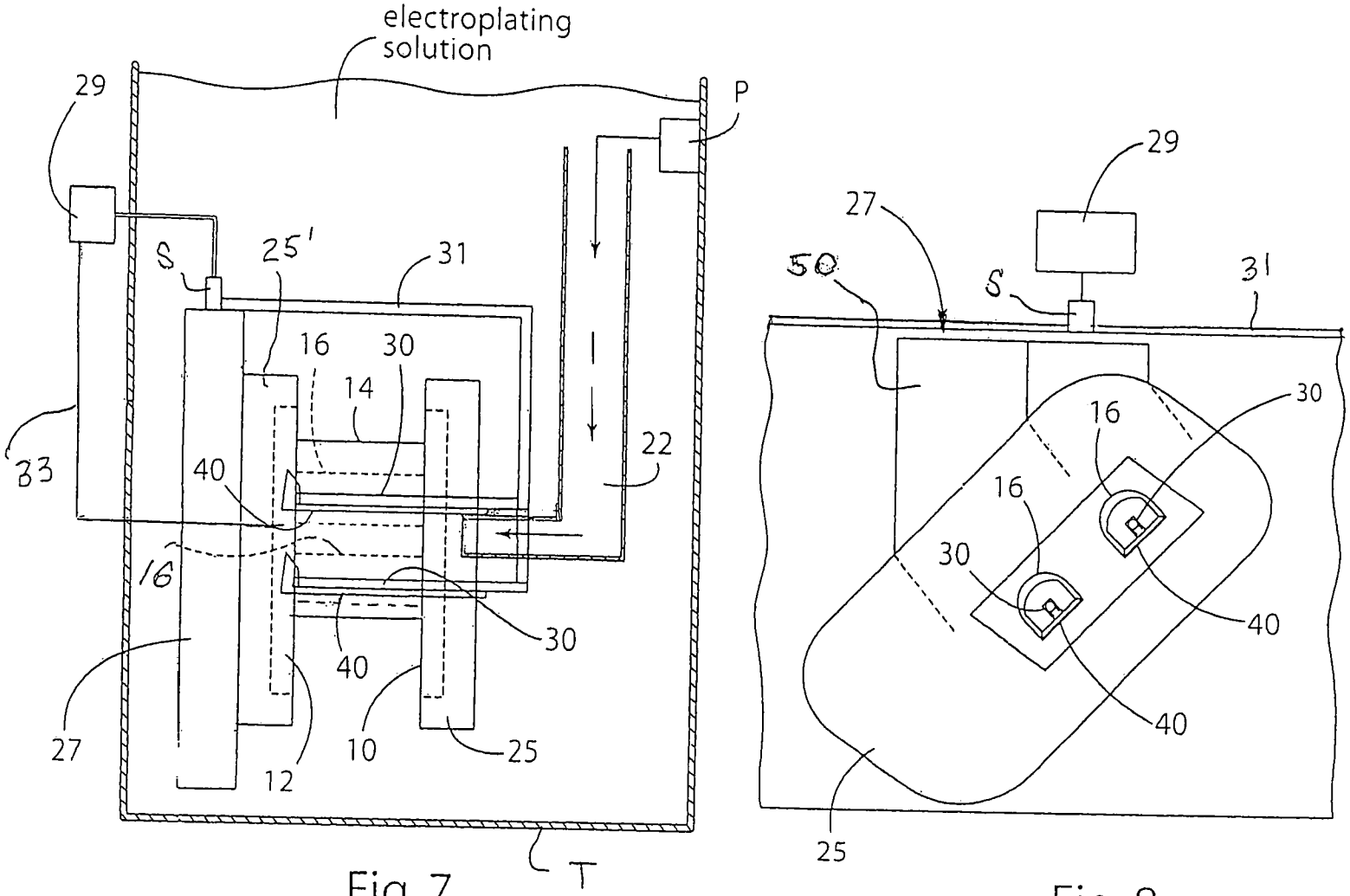
FIG. 7 is a schematic side view of the vane segment held in electrical current-supply tooling in an electroplating tank and showing the anodes connected to a bus bar to receive electrical current from a power source while the vane segment is made the cathode of the electrolytic cell.
FIG. 8 is an end view of the mask and electrical current-supply tooling and also partially showing external anodes for plating the exterior airfoil surface of the vane segment.

Referring to FIGS. 2 and 7, a vanc segment 5 is shown having a water-tight, flexible mask 25 fitted to the shroud region 10 to prevent plating of that masked shroud area 10 where the cavity 16 has open end 16*a*. The other shroud region 12 is covered by a similar mask 25' to this same end, the mask 25' being attached on the fixture or tooling 27, FIG. 7. The masks can be made of Hypalon® material, rubber or other suitable material. The mask 25 includes an opening 25*a* through which the noble metal-containing electroplating solution is flowed into each cooling cavity 16. To this end, an electroplating solution supply conduit 22 is received in the mask opening 25*a* with the discharge end of the conduit 22 located between the anodes 30 proximate to cavity open ends 16*a* to supply electroplating solution to both cooling cavities 16 during at least part of the electroplating time, either continuously or periodically or otherwise, to replenish the Pt-containing solution in the cavities 16. Alternatively, the conduit 22 can be configured and sized to occupy most of the mask opening 25*a* to this same end with the anodes 30 extending through and out of the plastic conduit 22 for connection to electrical power supply 29. The plastic supply conduit 22 is connected a tank-mounted pump P, which supplies the electroplating solution to the conduit 22. The electroplating solution is thereby supplied by the pump P to both cooling cavities 16 via the mask opening 25*a*. For purposes of illustration and not limitation, a typical flow rate of the electroplating solution can be 15 gallons per minute or other suitable flow rate. The conduit 22 includes back pressure relief holes 22*a* to prevent pressure in the cooling cavities 16 from rising high enough to dislodge the mask 25 from the shroud region 10 during electroplating.

Electroplating takes place in a tank T containing the electroplating solution with the vane segment 5 held submerged in the electroplating solution on electrical current-supply fixture or tooling 27, FIG. 7. The fixture or tooling 27 can be made of polypropylene or other electrical insulating material. The tooling includes electrical anode contact stud S connected to electrical power supply 29 and to an electrical current supply anode bus 31. The anodes 30 receive electrical current via extensions of electrical current supply bus 31 connected to the anode contact stud that is connected to electrical power supply 29. The vane segment 5 is made the cathode in the electrolytic cell by an electrical cathode bus 33 in electrical contact at the shroud region 12 and extending through the polypropylene tooling 27 to the negative terminal of the power supply 29.

Each respective elongated anode 30 extends through the mask opening 25*a* as shown in FIG. 7 and into each cooling cavity 16 along its length but short of its dead (closed) end (defined by surface area 23). The anode 30 is shown as a cylindrical, rod-shaped anode, although other anode shapes can be employed in practice of the invention. The anode 30 has opposite end regions 30*a*, 30*b* supported on ends of an electrical insulating anode support 40, FIGS. 4, 5, and 6, which can made of machined polypropylene or other suitable electrical insulating material. The support 40 comprises a side-tapered base 40*b* having an upstanding, longitudinal rib 40*a* on which the anode 30 resides. Engagement of the base 40*b* of each anode support on the generally flat surface area 21 of the respective cooling cavity 16 holds the anode in position in the cooling cavity relative to the surface area 20 to be plated and masks surface area 21 from being plated. One end of the anode is located by upstanding anode locator rib 41 and the opposite end is located in opening 43 in an integral masking shield 45 of the support 40.

The anode 30 and the anode support 40 collectively have a configuration and dimensions generally complementary to that of each cooling cavity 16 that enable the assembly of anode and anode support to be positioned in the cooling cavity 16 spaced from (out of contact with) the surface area 20 of internal wall W defining the cooling cavity yet masking surface area 21. The anode support 40 is configured with base 40*b* that functions as a mask of surface area 21 so that only surface area 20 is electroplated. Surface areas 21, 23 are left un-plated as a result of masking effect of the base 40*b* and integral masking shield 45 of the anode support 40. Such areas 21, 23 are left uncoated when coating is not required there for the intended service application and to save on noble metal costs.

When electroplating a vane segment made of a nickel base superalloy, the anode can comprise conventional Nickel 200 metal, although other suitable anode materials can be sued including, but not limited to, platinum-plated titanium, platinum-clad titanium, graphite, iridium oxide coated anode material and others.

The electroplating solution in the tank T comprises any suitable noble metal-containing electroplating solution for depositing a layer of noble metal layer on surface area 20. For purposes of illustration and not limitation, the electroplating solution can comprise an aqueous Pt-containing KOH solution of the type described in U.S. Pat. No. 5,788,823 having 9.5 to 12 grams/liter Pt by weight (or other amount of Pt), the disclosure of which is incorporated herein by reference, although the invention can be practiced using any suitable noble metal-containing electroplating solution including, but not limited to, hexachloroplatinic acid ($H_2PtCl_6$) as a source of Pt in a phosphate buffer solution (U.S. Pat. No. 3,677,789), an acid chloride solution, sulfate solution using a Pt salt precursor such as $[(NH_3)_2Pt(NO_2)_2]$ or $H_2Pt(NO_2)_2SO_4$, and a platinum Q salt bath ($[NH_3)_4Pt(HPO_4)]$ described in U.S. Pat. No. 5,102,509).

Figure 9:
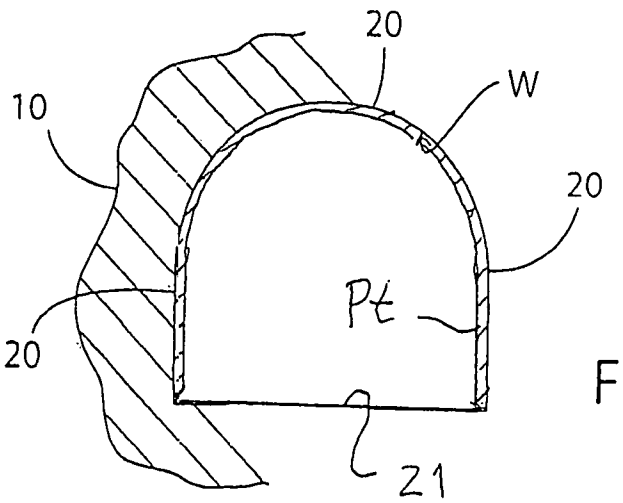
FIG. 9 is a schematic end view of the gas turbine engine vane segment showing the Pt electroplated layer on a certain surface area.

Each anode 30 is connected by extensions to electrical current supply anode bus 31 to conventional power source 29 to provide electrical current (amperage) or voltage for the electroplating operation, while the electroplating solution is continuously or periodically or otherwise pumped into the cooling cavities 16 to replenish the Pt available for electroplating and deposit a Pt layer having substantially uniform thickness on the selected surface area 20 of the internal wall W of each cooling cavity 16, while masking areas 21, 23 from being plated. The electroplating solution can flow through the cavities 16 and exit out of the cooling air exit passages 18 into the tank. The vane segment 5 is made the cathode by electrical cathode bus 33. For purposes of illustration and not limitation and to FIG. 9, the Pt layer is deposited to provide a 0.25 mil to 0.35 mil thickness of Pt on the selected surface area 20, although the thickness is not so limited and can be chosen to suit any particular coating application. Also for purposes of illustration and not limitation, an electroplating current of from 0.010 to 0.020 amp/cm$^2$ can be used for a selected time to deposit Pt of such thickness using the Pt-containing KOH electroplating solution described in U.S. Pat. No. 5,788,823.

During electroplating of each cooling cavities 16, the external airfoil surfaces of the vane segment 5 (between the masked shroud regions 10, 12) optionally can be electroplated with the noble metal (e.g. Pt, etc.) as well using other anodes 50 (partially shown in FIG. 8) disposed on the tooling 27 external of the vane segment 5 and connected to anode bus 31 on the tank T, or the external surfaces of the vane segment can be masked completely or partially to prevent any electrodeposition thereon.

Following electroplating and removal of the anode and its anode support from the vane segment, a diffusion aluminide coating is formed on the plated internal surface area 20 and the unplated internal surface areas 21, 23 by conventional gas phase aluminizing (e.g. CVD, above-the-pack, etc.), pack aluminizing, or any suitable aluminizing method. The diffusion aluminide coating formed on surface area 20 includes an amount of the noble metal (e.g. Pt) enrichment to improve its high temperature performance. That is, the diffusion aluminide coating will be enriched in Pt to provide a Pt-modified diffusion aluminide coating at surface area 20 where the Pt layer formerly resided, FIG. 9, as result of the presence of the Pt electroplated layer, which is incorporated into the diffusion aluminide as it is grown on the vane segment substrate to form a Pt-modified NiAl coating. The diffusion coating formed on the other unplated surface areas 21, 23 would not include the noble metal. The diffusion aluminide coating can be formed by low activity CVD (chemical vapor deposition) aluminizing at 1975 degree F. substrate temperature for 9 hours using aluminum chloride-containing coating gas from external generator(s) as described in U.S. Pat. Nos. 5,261,963 and 5,264,245, the disclosures and teachings of both of which are incorporated herein by reference. Also, CVD aluminizing can be conducted as described in U.S. Pat. Nos. 5,788,823 and 6,793,966, the disclosures and teachings of both of which are incorporated herein by reference.

Although the present invention has been described with respect to certain illustrative embodiments, those skilled in the art will appreciate that modifications and changes can be made therein within the scope of the invention as set forth in the appended claims.

The invention claimed is:

1. Apparatus for electroplating a surface area of an internal wall defining a cavity present in a gas turbine engine airfoil component, comprising an anode supported on an L-shaped electrical insulating anode support with a first portion defining a long leg of the L-shape extending beside and along one side of the anode and a second portion defining a short leg of the L-shape, the first portion and the second portion joined at an intersection, the second portion extending at an angle from the first portion at the intersection and extending in a direction with a component transverse to the anode proximate an end of the anode, wherein the anode and the anode support are adapted to be positioned in the cavity so that the first portion of the anode support masks a first surface area of the internal wall that is not to be electroplated and the second portion of the anode support masks an adjacent second surface area of the internal wall that is not to be electroplated.

2. The apparatus of claim 1 including a pump to flow a noble-metal containing electroplating solution into the cavity.

3. The apparatus of claim 1 wherein the solution includes a metal comprising Pt, Pd, Au, Ag, Rh, Ru, Os, or Ir to deposit said metal on the surface area.

4. The apparatus of claim 1 wherein the electroplating solution is supplied to the cavity via a supply conduit having one or more back pressure relief openings.

5. The apparatus of claim 1 wherein the anode comprises nickel when the component is made of Ni base superalloy.

6. The apparatus of claim 1 wherein the component comprises a gas turbine engine vane or blade or segment thereof.

7. The apparatus of claim 1 wherein the assembly of the anode on the anode support is positioned in the cavity by engagement of a surface of the anode support with a surface of a wall defining the cavity.

8. The apparatus of claim 1 including a tank having the electroplating solution therein and in which the component with the anode therein is submerged.

9. Apparatus for electroplating a surface area of an internal wall defining a cavity with an open end and a blind end present in a gas turbine engine airfoil component, comprising an elongated anode supported on an electrical insulating anode support with a first portion and a second portion, the first portion extending linearly beside the anode, generally parallel thereto in the direction of elongation, the second portion extending at an angle from the first portion and generally transverse to the first portion proximate a distal end of the anode, wherein the anode and the anode support are adapted to be positioned in the cavity so that the first portion of the anode support masks a first surface area extending beside the first portion that is not to be electroplated and the second portion of the anode support masks a second surface area at the blind end of the cavity that is not to be electroplated.

* * * * *